US005437518A

United States Patent [19]

Maloberti et al.

[11] Patent Number: 5,437,518

[45] Date of Patent: Aug. 1, 1995

[54] DEVICE FOR MOUNTING A FLEXIBLE LINE COMPRISING A CURVATURE LIMITER

[75] Inventors: René Maloberti, Champigny; Alain Coutarel, Paris, both of France

[73] Assignee: COFLEXIP, Boulogne Billancourt, France

[21] Appl. No.: 43,874

[22] Filed: Apr. 7, 1993

[30] Foreign Application Priority Data

Apr. 7, 1992 [FR] France ..... 92 04229

[51] Int. Cl.[6] ..... F16L 1/04; E21B 43/013

[52] U.S. Cl. ..... 405/169; 166/342; 405/158; 405/171

[58] Field of Search ..... 405/169, 170, 171; 166/338-344

[56] References Cited

U.S. PATENT DOCUMENTS

| | | | |
|---|---|---|---|
| 3,955,599 | 5/1976 | Walker | 405/169 X |
| 4,095,437 | 6/1978 | Cox . | |
| 4,558,972 | 12/1985 | Langner . | |
| 4,570,716 | 2/1986 | Genini et al. | 405/169 X |
| 4,609,304 | 9/1986 | Labbe et al. | 405/169 X |
| 4,620,818 | 11/1986 | Langner | 405/170 X |
| 4,671,702 | 6/1987 | Langner | 166/342 X |
| 4,687,377 | 8/1987 | Langner . | |
| 4,688,966 | 8/1987 | Esparza . | |
| 4,808,034 | 2/1989 | Birch . | |
| 5,035,922 | 7/1991 | Titus . | |

*Primary Examiner*—Dennis L. Taylor
*Attorney, Agent, or Firm*—Hoffman, Wasson & Gitler

[57] ABSTRACT

A device for mounting a flexible line including a curvature limiter. The device for mounting a flexible line on a structure, including a hollow rigid member forming part of the structure or fixed to the structure, and which the flexible line passes through after having been pulled with the aid of a pull cable fixed to one end of the flexible line, in particular on the end fitting mounted on the latter for connecting it to the structure, and a curvature limiter engaged on the flexible line and secured to fixing means able to interact with fixing means secured to the hollow rigid member for fastening the curvature limiter to the structure. The device further includes means for immobilizing the curvature limiter on the flexible line at a distance from the end of the latter during a first phase of pulling the flexible line at the end of which the curvature limiter is brought to the level of the mouth zone of the hollow rigid member for the purpose of fastening it, the hollow rigid member comprising, at least during the first pulling phase, a flared mouthpiece.

12 Claims, 7 Drawing Sheets

DEVICE FOR MOUNTING A FLEXIBLE LINE COMPRISING A CURVATURE LIMITER

The subject of the present invention is a device for mounting a flexible line on a structure, comprising a hollow rigid member forming part of the said structure or fixed to the said structure, and which the flexible line passes through after having been pulled with the aid of a pull cable fixed to one end of the said flexible line, in particular on the end fitting mounted on the latter for connecting it to the said structure.

BACKGROUND OF THE INVENTION

The present invention is particularly intended for offshore oil prospecting.

In the sense of the invention flexible line is understood to mean flexible pipes, in particular flexible tubular pipes for transporting fluids such as hydrocarbons, composite bundles, umbilical cords, or electrical cables. Structure is understood to mean any fixed or moving structure which can be used in the offshore field, such as a fixed rigid Jacket structure, an oscillating structure rigidly attached to the sea bed or a floating structure such as a naval surface support, a semisubmersible platform, a floating vertical column which is anchored, connected to an oil tanker for storage/separation which is anchored to it, a buoy, etc.

More precisely, the invention relates to a device comprising a curvature limiter engaged on the said flexible line and secured to fixing means able to interact with fixing means secured to the said hollow rigid member for fastening the curvature limiter to the said structure.

Curvature limiter is understood to be any type of device making it possible to impose upon the flexible line a radius of curvature which is greater than a minimum radius of curvature in a zone where the flexible line is subjected to bending, particularly repeated bending, risking damaging it.

The curvature limiter may be of any known type, for example, made up of articulated rigid elements called vertebrae, or preferably in the form of a stiffener.

Known stiffeners are generally moulded blocks made from plastic such as a polyurethane, of at least partially frustoconical shape, installed on the flexible line and fastened to a fastening support mounted on and/or around the flexible line.

Fastening in the sense of the invention, is understood to be a rigid mechanical link, at least in bending and with respect to lateral translations, between the curvature limiter and its fastening support, that is to say a link such that the fastening support blocks the angular displacements (curvature about any axis perpendicular to the axis of the flexible line) and the transverse displacements of the curvature limiter and, consequently of the flexible line, the values associated with bending torques and bearing forces being wholly withstood by the fastening support. As a variant, the said fastening may be an integral fastening, also ensuring the blocking of the axial displacements and the torsion forces about the longitudinal axis of the flexible pipe.

The hollow rigid member is a part of the structure or a member securely fastened onto the structure, such as a platform, to which one end of the flexible pipe is connected, the said hollow rigid member comprising a central opening for the passage of the flexible line and constituting the last bearing point of the flexible line on the support platform, like a hawsepipe. The hollow rigid member which constitutes the fastening support for the curvature limiter is commonly an end section of a tube guide in which the flexible line is engaged, fastening being effected in the lower mouth zone of the end section of the tube guide.

Tube guide, in the sense of the invention, is understood equally well to be a vertical tubular element (I tube) as a progressive deviation tubular element (J tube). The function of the tube guide may, as a variant, be fulfilled by a lattice, or any other form of framework having an internal passage for guiding the flexible line.

The technique consisting in pulling a flexible line via one end through a tube guide secured to a structure, called the pull-in technique is commonly used in the offshore oil field.

This technique may be used in various configurations of exploitation systems of subsea oil fields and for example in a production installation comprising one or more pipes or flow-lines connecting the various subsea wellheads, or other equipment arranged on the seabed, to a structure forming a surface support such as described hereinabove or to a subsurface structure located at an intermediate level between the surface and the subsea bed, the said structure comprising various equipment and, particularly, pipework elements which must be connected via the flexible pipe to the equipment arranged on the seabed. Alternatively, the production installation may comprise, instead of equipment arranged on the seabed, a second surface support, or subsurface support, to which is connected the second end of the flexible pipe which is either entirely suspended as a chain between the two supports, or partially rests on the seabed.

In a first implementation of this type of installation, a flexible pipe is unrolled from a laying ship, a first end of the pipe being pulled by the pull-in technique so as to be able to connect this first end of the flexible pipe on board the surface support opposite which the laying ship is positioned.

The flexible pipe is then suspended as a chain between the laying ship and the surface support. Next, the laying ship moves away and starts to unroll the flexible pipe onto the seabed.

In a second implementation, once the flexible pipe has been laid over practically its entire length by the laying ship on the subsea bed, the second end of the flexible pipe is connected via a pulling cable to the surface support then pulled aboard and connected.

The connection between the terminal fitting of the flexible pipe and the network of pipework installed on the structure forming the support is usually performed above the surface of the water, at the level of a working bridge for example. Such a device has the advantage of facilitating the connection of the flexible pipe on board the platform. In contrast, despite the possibility for arranging, around the upper end of the flexible pipe a curvature limiter in the form of a stiffener securely fastened with respect to the support structure, this device exhibits relatively serious risks for the flexible tubular pipe which, devoid of protection, must pass through the splash zone.

In addition, when the support structure is floating, anchored, the flexible tubular pipe undergoes the consequences of excursion of the structure to which it is to be fixed, particularly due to the fact that the latter, pulling on its anchorages, moves away from its theoretical resting place with respect to the vertical.

According to another known device, in particular when the structure is an anchored floating platform, the connection between the flexible pipe and the platform is produced below the water surface, preferably in the bottom part of the platform in the vicinity of the keel. The advantage of such a device is that it puts the flexible pipe in relative shelter, moving it away from the zone of maximum turbulence created at the surface by the swell. It is, nevertheless, commonly considered necessary to install, in line with the connection of the flexible line to the structure, at the lower end of the tube guide secured to the structure, a curvature limiter in the form of a stiffener, securely fastened, and aiming to distribute the bending stresses and to prevent the radius of curvature imparted on the flexible line from attaining a critical lower value below the value at which the flexible line risks rapidly being put out of service. Such a device has the obvious drawback of requiring difficult and costly operations dependent upon weather conditions, in order to produce the subsea connections.

Moreover, U.S. Pat. No. 4,808,034 describes a device for connecting a flexible pipe to a floating structure in which an annular guide plate is connected to a stiffener mounted with clearance about the flexible pipe. The guide plate comprises, projecting from its front end, fixing pieces interacting with corresponding recessed pieces produced at the lower end of the vertical tube guide fixed to the structure.

In this embodiment, essentially two pulling phases are implemented with the aid of various lifting cables.

First of all, cables are fixed to the fixing pieces arranged projecting at the periphery of the guide plate and the assembly constituted by the guide plate secured to the stiffener and the pipe equipped with its fitting are pulled upwards, this said fitting finding itself bearing on the shoulder made up by the inner edge of the guide plate. Another lifting cable arranged axially and fixed to the fitting is brought up simultaneously.

Once the guide plate has been secured to the end of the tube guide, the said other lifting cable, fixed to the fitting, is used to pull the latter as well as the flexible line, through the tube guide, the fitting then being connected to the structure in a known manner at, or beyond the upper end of the tube guide.

This known device requires use of a plurality of pulling cables during various stages.

During the first phase of the operation for installing the device, it is necessary to haul several cables at once, balancing their respective lengths and tensions in order to pull on the guide plate which entrains the fitting and the flexible pipe and, furthermore, it is necessary simultaneously to bring the axial lifting cable with a minimum pulling force just sufficient for preventing this cable from having any slack.

This device is very difficult to implement, in particular in the case of flexible lines a certain length of which rests on the seabed, in order to carry out the pulling of flexible lines of long length and high weight, to which weight is added the weight of the fitting, of the stiffener and of the guide plate. In addition, the device described in the prior document is, bearing in mind the configuration of the means provided for the relative positioning and fixing of the guide plate and of the end of the tube guide, limited to an implementation with a vertical tube guide. Furthermore, this device presents the serious drawback that the fastening of the stiffener, such as produced by fixing the guide plate onto the end of the tube guide, lacks security.

The present invention proposes to produce a device which is easier to implement than the previously known devices, and is not limited to an implementation with a vertical tube guide, whilst allowing an effective and reliable fastening of the curvature limiter, and particularly under the water and preferably without the intervention of divers.

SUMMARY OF THE INVENTION

The subject of the present invention is essentially a device for mounting a flexible line on a structure, comprising a hollow rigid member forming part of the said structure or fixed to the said structure, and which the flexible line passes through after having been pulled with the aid of a pull cable fixed to one end of the said flexible line, preferably on the end fitting mounted on the said flexible line for connecting it to the said structure, and a curvature limiter engaged on the said flexible line and secured to fixing means able to interact with fixing means secured to the said hollow rigid member for fastening the curvature limiter to the said structure, characterised in that it comprises means for immobilising the curvature limiter on the said flexible line at a distance from the said end of the latter during a first phase of pulling the flexible line at the end of which the curvature limiter is brought to the level of the mouth zone of the said hollow rigid member for the purpose of fastening it, the said hollow rigid member comprising, at least during the said first pulling phase, a flared mouthpiece.

The operation for installing the flexible pipe and the connection device according to the invention comprises two phases of pulling the flexible pipe by pull-in, these two phases being separated by an intermediate stage during which the curvature limiter is immobilised on the structure. It is appropriate to note that, according to the invention, pulling the flexible pipe during each of the two successive pulling phases is carried out by hauling one and the same cable which is the pulling cable fixed to the terminal fitting of the flexible pipe. The device according to the invention thus has the advantage of allowing an easy installation operation, in comparison with the device described in U.S. Pat No. 4,808,034, which requires a set of complementary cables fixed peripherally to projecting end pieces of the guide plate mounted on the curvature limiter in order to carry out the first pulling phase preceding the fixing of the guide plate to the lower end of the tube guide.

Another advantage of the device according to the invention is that, during the entire duration of the operation for installing the flexible pipe and, subsequently, during use of the installation in service, it allows, at the critical point corresponding to the upper zone of the free part of the flexible pipe which is located Just below the mouth zone of the hollow rigid member serving as a hawsepipe, an even distribution of the bending stresses and limitation in the radius of curvature of the flexible line with respect to the minimum permitted value to be ensured permanently. During the first phase of the pulling operation, this result is obtained by virtue of the flared mouthpiece provided in the mouth zone of the hollow rigid member, such as the end section of a tube guide. During the second phase of the pulling operation, as well as in a permanent fashion, during the duration of use of the installation in service, this function of controlling the curvature of the flexible line is performed by the curvature limiter which has been fastened onto the structure.

The device according to the invention has the further advantage of allowing a secure fastening of the curvature limiter, it being possible for the installation operation to be carried out easily. In particular, in an advantageous implementation, the installation of the device is produced without divers by virtue of members remotely controlled from the surface.

In a first embodiment, the means for immobilising the curvature limiter on the flexible line during the said first pulling phase are releasable from the said curvature limiter after immobilising the latter. In this case, the curvature limiter is mounted on the flexible line with radial clearance, so as to allow, after releasing the immobilisation means from the curvature limiter, which means remain locked axially on the flexible line, a sliding of the flexible line with respect to the curvature limiter.

Thus, after carrying out the fastening, it is possible to implement, with the aid of the same pulling cable, the second pulling phase allowing the permanent installation of the flexible line by sliding inside the hollow rigid member until final connection of the end fitting to the structure.

In this first embodiment, the flared mouthpiece may be permanently mounted on the hollow rigid member or is separable in order to allow the implementation of the mechanical members which perform the fastening.

The curvature limiter may be fastened by any suitable means particularly by assembly, with the aid of fixing members, opposing flanges of the curvature limiter and of the hollow rigid member, or by engagement with correspondence of shapes of two opposing complementary bearing surfaces which are, for example, frustoconical, of the curvature limiter and of the hollow rigid member or of the flared mouthpiece. The complementary bearing surfaces are preferably applied against each other with sufficient axial force by clamping means, such as a screw/nut assembly or advantageously a clamping collar with wedge effect.

In a second embodiment of the invention, the means for immobilising the curvature limiter on the flexible line perform a permanent fastening of the curvature limiter on the flexible line, the fastening being performed by sliding interlocking of opposing cylindrical bearing surfaces secured to the curvature limiter and to the hollow rigid member.

In this case, the distance between the location at which the curvature limiter is immobilised on the flexible line and the end of the flexible line which is to be connected to the structure, must be predetermined so that, in the fastening position of the curvature limiter, the end of the flexible line is at the planned level for its connection to the structure.

BRIEF DESCRIPTION OF DRAWING

Other advantages and features of the invention will emerge upon reading the following description of various embodiment examples given with no limitation implied and with reference to the appended drawing in which.

DETAILED DESCRIPTION OF THE INVENTION

Figure 1:
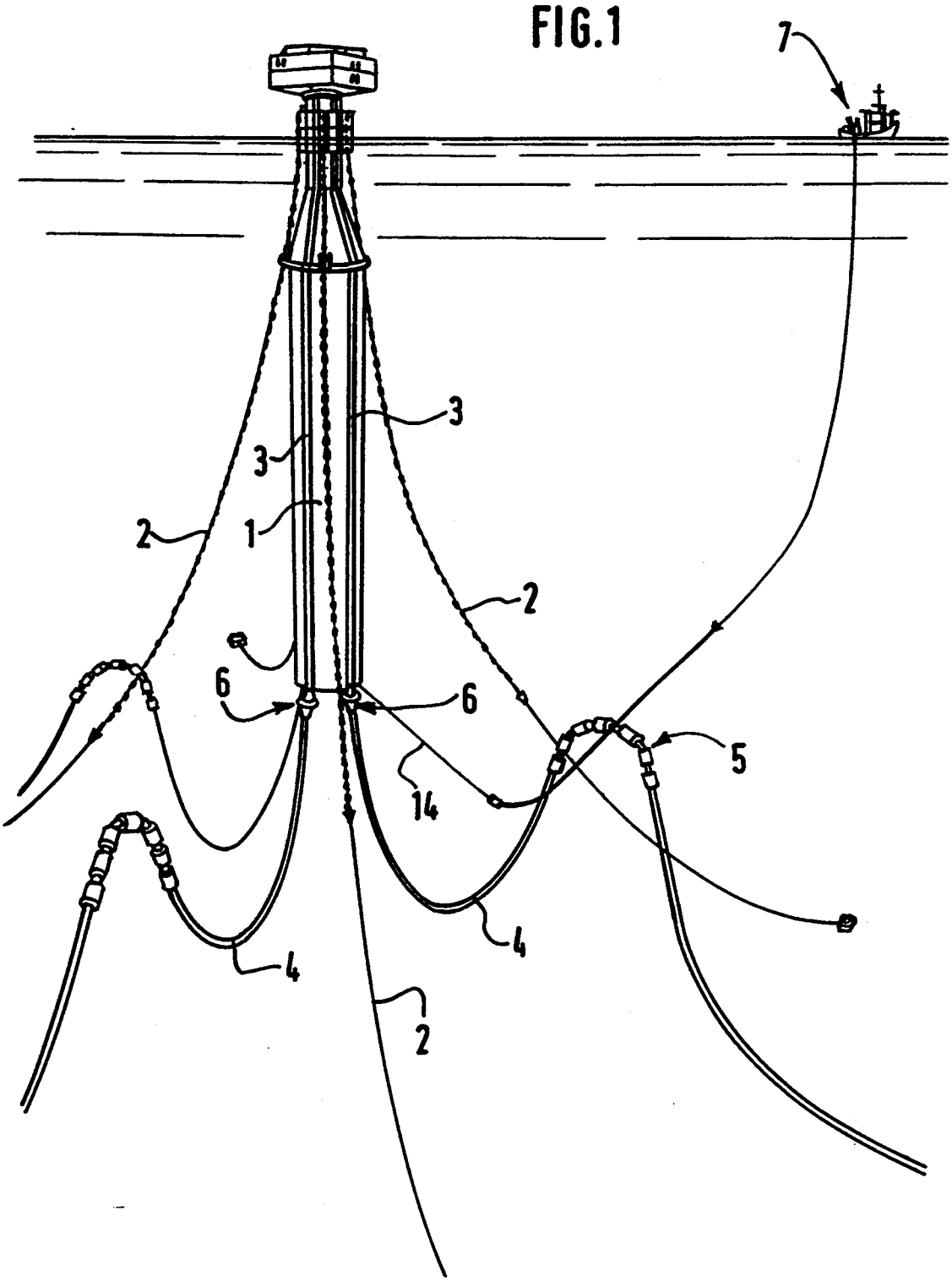
FIG. 1 diagrammatically illustrates an offshore oil installation in which the device according to the invention may be implemented.

Referring firstly to FIG. 1 where an offshore hydrocarbon production installation comprising a floating vertical column 1 fitted with anchoring lines 2 to the subsea bed can be seen.

Along the structure which the floating column 1 constitutes, there are fixed rigid tube guides 3 inside which there are engaged, for raising hydrocarbons, flexible tubular pipes 4 which may be of the type of those manufactured and marketed in long lengths and various diameters by the Applicant Company.

The flexible tubular pipes 4 are equipped, in a known manner, with a set of buoys 5 so as to determine a zone with concavity in the opposite direction directed towards the seabed.

In the connection zone of each flexible tubular pipe 4 to the lower end of the corresponding tube guide 3, there is provided a curvature limiting element 6 which will be described in more detail later.

FIG. 1 also diagrammatically represents a ship 7 used for laying flexible tubular pipes 4.

Figure 2:
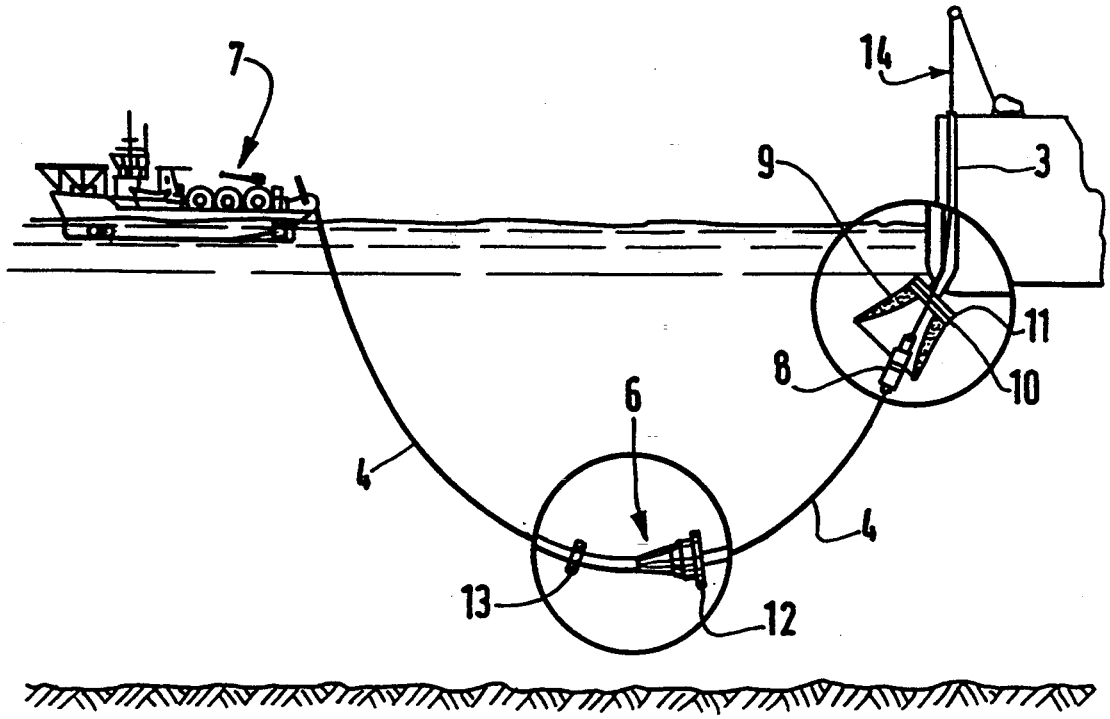
FIGS. 2 to 4 illustrate various implementation phases of a first embodiment of the device according to the invention, FIG. 2 comprising two zones depicted on a larger scale, FIGS. 5 to 8 diagrammatically illustrate various implementation phases of a second embodiment of the device according to the invention, FIG. 5 comprising two zones depicted on a larger scale, FIGS. 9 and 10 diagrammatically illustrate a variant of this second embodiment.
Figure 3:
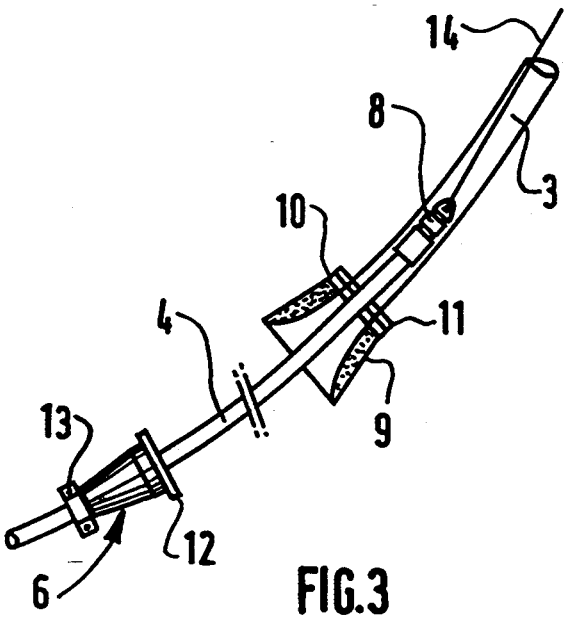
Figure 4:
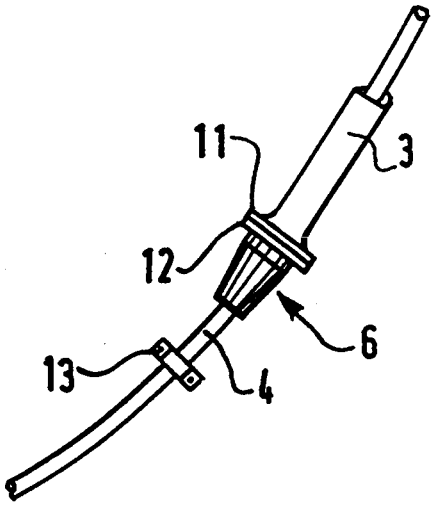

Reference is now made to FIGS. 2 to 4 which illustrate a first embodiment of the device according to the invention, as well as the stages for installing it.

The curvature limiter 6 of this embodiment is produced in the form of a stiffener, particularly made of polyurethane, installed with radial clearance on the flexible tubular pipe 4 before the latter has been fitted with its end fitting 8. This radial clearance allows a relative sliding between the stiffener and the flexible pipe after fastening the stiffener, described hereinbelow.

The stiffener may be of any known type and in particular of one of the types described in the patent application PCT/FR91/01073 of the Applicant Company.

On the lower mouth end of the tube guide 3 there is mounted a mouthpiece 9, in the shape of a trumpet, comprising a flange 10 for fixing it to a flange 11 at the mouth end of the tube guide 3.

The stiffener 6 comprises a flange 12 at its front end.

An immobilisation means, such as a retention collar 13, is installed and securely fixed to the flexible pipe 4 at the rear of the stiffener 6 so as to immobilise the latter in position on the flexible tubular pipe during the first phase of raising the latter up, as will be described, it being possible for the said collar 13 to be separated from the stiffener 6, once the fastening has been produced.

In order to raise up the flexible pipe by pulling, the fitting 8 is connected to the end of a pulling cable 14 associated with lifting means, such as a hoist mounted on the structure, such as the column 1 to which the flexible tubular pipe is to be connected.

In order to implement the device according to the invention, an upwards pulling force is exerted on the cable 14, which brings about the raising of the assembly consisting of the fitting 8, the flexible tubular part 4 and the stiffener 6, held in abutment by the collar 13, until the fitting 8, after having passed through the flared mouthpiece 9 in the shape of a trumpet at the lower end of the tube guide 3, penetrates into the latter entraining the pipe 4.

During this intermediate phase, illustrated in FIG. 3, the flared mouthpiece 9 provides a continuous support with a determined curvature for supporting the flexible pipe in its critical zone so as to keep its radius of curvature above the minimum permissible value and to prevent damage to it.

By continuing to pull the cable 14, the stiffener 6 comes into the vicinity of the flared mouthpiece 9.

The mouthpiece is then dismantled by disassembling the flanges 10 and 11, which then makes it possible to assemble the flange 12 of the stiffener 6 with the flange 11 at the lower end of the tube guide 3.

This securing of the flanges produces a reliable fastening of the stiffener to the lower end of the tube guide.

After performing the fastening, the collar 13 may be left in place on the pipe 4.

Figures 6, 7, 8:
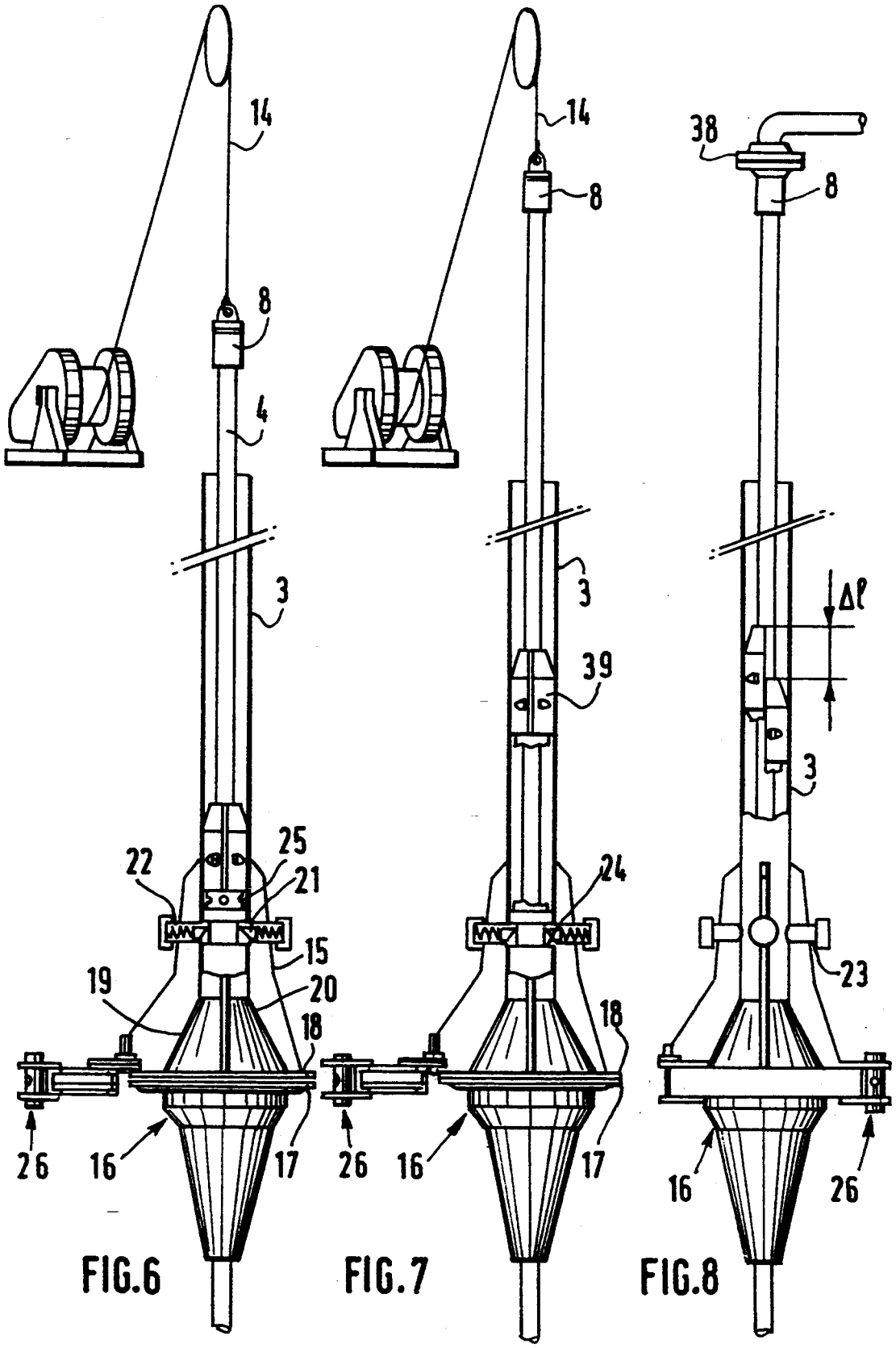

Preferably, the collar 13 is fixed in advance to the flexible line 4 in a position such that the length of flexible line between the collar and the fitting 8 is sufficient so that the collar is a certain distance away with respect to the back end of the stiffener when, once the pulling operation is finished, the fitting 8 is permanently connected to a connection member of the support platform such as a flange 38 (FIG. 8). This arrangement, illustrated in FIG. 4, makes it possible to avoid the collar 13 knocking into the stiffener 6 when, subsequently, the length of the flexible pipe 4 is made to vary slightly as a function of the service conditions, for example due to the internal pressure in the pipe, by sliding inside the stiffener 6.

In order to carry out the installation in these conditions, it is possible, for example, to proceed as follows: the flexible pipe 4 is lifted up as far as possible so that, with the collar 13 pushing the stiffener 6 with the flange 12 against the flange 11, the stiffener 6 is fastened by fixing the two opposed flanges together for example by bolts, with the fitting 8 located at a level which is slightly raised with respect to the flange 38 to which it is to be connected.

The connection is then made between the fitting 8 and the flange 38 by slightly relowering the flexible pipe 4, which slides through the stiffener 6 which makes it possible to move the collar 13 away with respect to the stiffener.

As a variant, it is possible to mount the collar 13 secured, in a separable manner, to the stiffener 6, via mechanical connection members able to be broken so as to allow the relative sliding between the stiffener and the flexible pipe once the fastening has been made, the collar 13 preferably being fixed in front of the stiffener 6.

For this purpose, various methods are possible.

Thus, it is possible to connect the collar to the stiffener using members such as cables capable of being cut, particularly by divers.

As a variant, it is possible to provide remotely controllable means for producing this separation or even to produce between the collar and the stiffener, a link which is separable under the effect of tension on the flexible tubular pipe after producing the fastening, of the type for example of links which will be described later with respect to the embodiments of FIGS. 5 to 11.

It is noted, by examining the drawing, that the tube guide 3 used in the embodiment illustrated is of the J tube type, that is to say a progressive deviation tube. Thus, it can be understood that the invention is in no way limited to the implementation with a vertical tube guide of the I tube type.

Reference is now made to FIGS. 5 to 8 which illustrate a second embodiment of the device according to the invention.

In this embodiment, the mouthpiece 15 in the shape of a trumpet is, in contrast to that of the preceding embodiment, mounted permanently at the lower end of the tube guide 3.

The stiffener 16 is equipped with a fixing flange 17 capable of coming to bear on an end flange 18 provided at the end of the mouthpiece 15.

In this embodiment, the stiffener 16 and the flange 17 are secured to a male frustoconical part 19 which is made up of a rigid structure, for example made from steel sheet, surrounding, with clearance, the flexible pipe 4 and whose external surface, which may be continuous or discontinuous, constitutes a fastening bearing surface of frustoconical overall shape which corresponds to that of the female frustoconical recess 20 of the mouthpiece 15. Preferably, the opposing surfaces of the frustoconical parts, respectively male and female, 19 and 20 form axisymmetric and regular geometric surfaces. Advantageously, these surfaces are in the shapes of cones of revolution of like angle.

The mouthpiece 15 comprises a plurality of pawls 21, pushed by springs 22, and able to slide in casings 23 arranged radially in one and the same plane perpendicular to the axis of the central cylindrical passage which the component 15 exhibits and in which the flexible pipe 4 is to be housed.

For engagement of the pawls 21, there is provided a groove 24 in the outer surface of a front part which extends the frustoconical male part 19 and which constitutes a rigid structure secured to this male frustoconical part 19. This front part has a central passage, for example a cylindrical one, inside which the flexible pipe 4 is arranged, and an external surface, of, for example, cylindrical overall shape such that it may take up place inside the upper part of the mouthpiece 15.

The front end of the front part secured to the male frustoconical part 19 comprises an element 39 produced so as to be able to be clamped in a fixed manner on the flexible pipe 4. Between the clamping element 39 and the groove 24, the front part secured to the male frustoconical part 19 comprises a breaking zone 25 which has a limited predetermined resistance to the axial pulling force, so as to be able to be broken when the cable 14 exerts a tension greater than the limiting resistance. The breaking zone 25 may be produced according to any known principle, for example using a cylindrical sleeve of reduced thickness, a cylindrical sleeve comprising a plurality of holes of a certain diameter, or a groove, or even a plurality of longitudinal studs forming a cylindrical cage.

Figure 5:
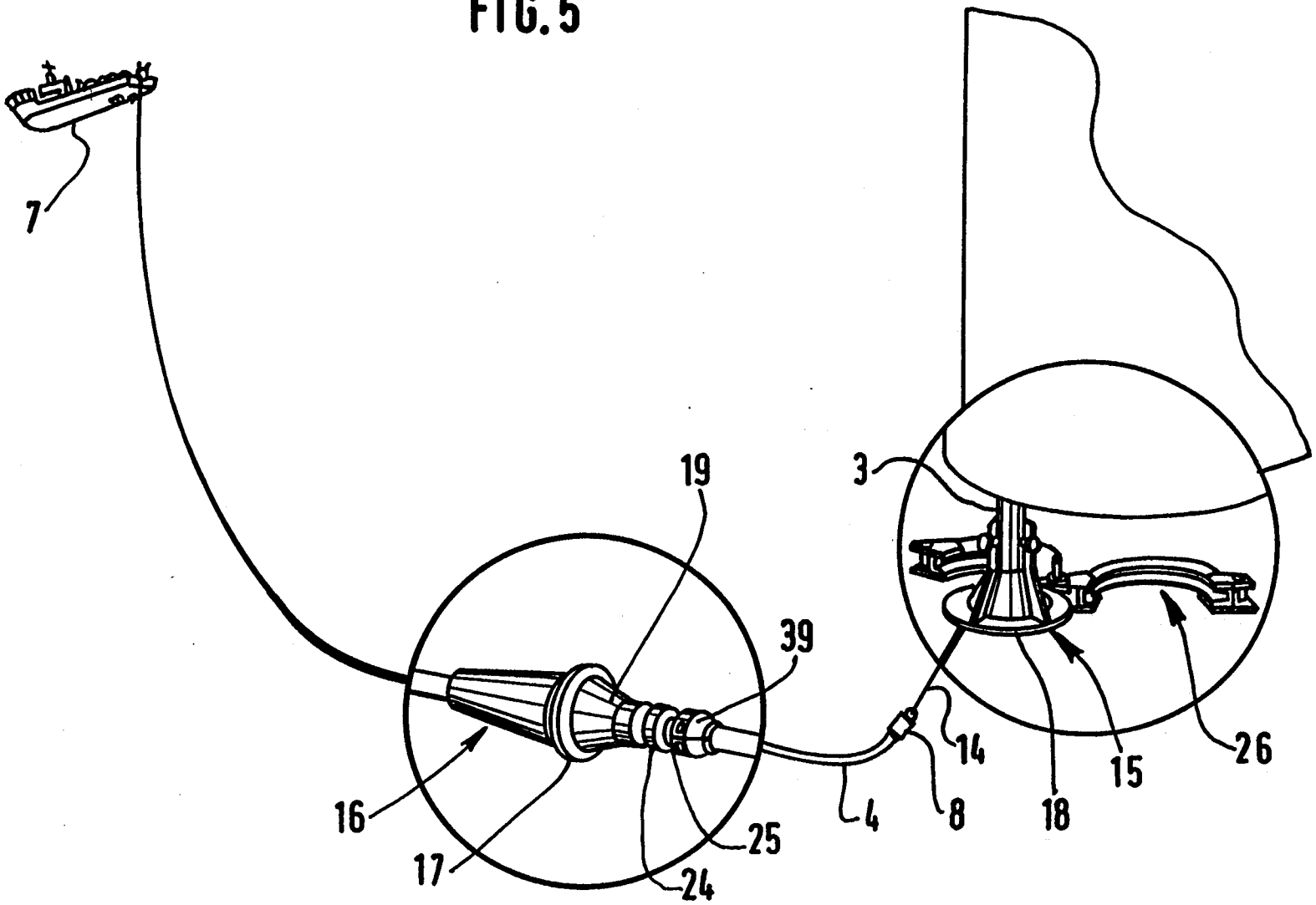

In order to produce the engagement and immobilisation in the mouthpiece 15 of the assembly consisting of the stiffener 16, the flange 17 and the male frustoconical part 19, as will be explained hereafter, an upwards pull, as illustrated in FIGS. 5 and 6 is exerted on the pull cable 14 raising up the flexible tubular pipe 4 by means of its end fitting 8, the said assembly thus being driven simultaneously by virtue of the clamping element 39 securely fixed to the pipe 4.

At one moment of the displacement, with the end fitting 8 having penetrated into the mouthpiece 15, the flexible pipe 4 is guided into the female frustoconical bearing surface which, like the mouthpiece 9 of the preceding embodiment, makes it possible to keep its radius of curvature above the minimum permissible value.

In the rest of the displacement, the frustoconical part 19 at the front of the stiffener 16 comes to the level of the female frustoconical part 20 of the mouthpiece 15. Simultaneously the pawls 21 engage in the groove 24 immobilising the stiffener with respect to the tube guide. The pawls may have an asymmetric profile allowing, combined with the profile of the groove 24, the automatic engagement in the direction of upwards pulling and the locking of the device in the opposite direction. In the embodiment illustrated by FIGS. 5 to 8, the pawls 21 provide immobilisation of the stiffener 16 in a temporary fashion, prior to it being fastened, so that performing the fastening is made easier. Advantageously, the width of the groove 24 in the direction of the axis of the flexible pipe is slightly greater than that of the pawls 21, the resulting longitudinal clearance making it possible to perform the fastening much more easily and more securely. The flanges 17 and 18 are therefore opposing, at the beginning of contact or at a very small distance, without, nevertheless, being clamped.

By continuing to pull the end of the flexible tubular pipe the breaking zone 25 is torn away as illustrated in FIG. 7, the flexible tubular pipe 4 being able to slide inside the tube guide 3 as far as its final position for connection to the support platform, the terminal fitting 8 being connected to the connection member such as the flange 38 secured to the platform (FIG. 8).

In order to produce the fastening, there is provided, according to the invention, in the case of the variant illustrated by FIGS. 5 to 8, a clamping collar 26 comprising two Jaws articulated about the mouthpiece 15, able to cap the opposing flanges 17 and 18, the peripheral profile of the flanges and the peripheral profile of the Jaws being matched so that, when the collar is applied to the flanges, a wedge effect causes the flanges to move towards each other axially so as to bring the frustoconical parts 19 and 20, respectively secured to the stiffener and to the mouthpiece, into clamped contact. Preferably, at least one of the flanges and the corresponding part of the collar 26 have a ramp-shaped peripheral profile making it possible to obtain, by virtue of a relatively low clamping force of the collar, sufficient axial compression force between the male and female frustoconical parts 19 and 20 so as to perform a solid fastening. The collar 26 may be a member which is independent of the other elements of the device, or it may be carried by the assembly consisting of the stiffener 16 and the male frustoconical part 19, or even, as illustrated in the advantageous variant of FIGS. 5 to 8, it may be supported by the mouthpiece 15.

A very effective fastening is thus provided between the stiffener and the fastening support consisting of the mouthpiece at the lower end of the tube guide, by virtue of the conical interlocking effect between the complementary frustoconical bearing surfaces 19 and 20.

It is to be noted that the clamping function from the outside performed by the collar 26 essentially has the effect of making sure that axial forces, which are relatively weak, are taken up, and not of providing resistance to the bending moments applied by the flexible tubular pipe and transmitted via the stiffener 16. These bending moments which are, in practice, very significant, are directly taken up by the interaction in correspondence of shape, in the vicinity of the conical interlocking of the bearing surfaces 19 and 20.

The operation for closing the Jaws of the clamping collar 26, which allows, as described hereinabove, clamping and locking to be carried out, performing the permanent fastening of the fastening bearing surfaces 19 and 20, may be performed as soon as the pawls 21 are in place in the groove 24, or alternatively, once the flexible pipe 4 has been installed and the fitting 8 connected to the platform.

Figure 9:
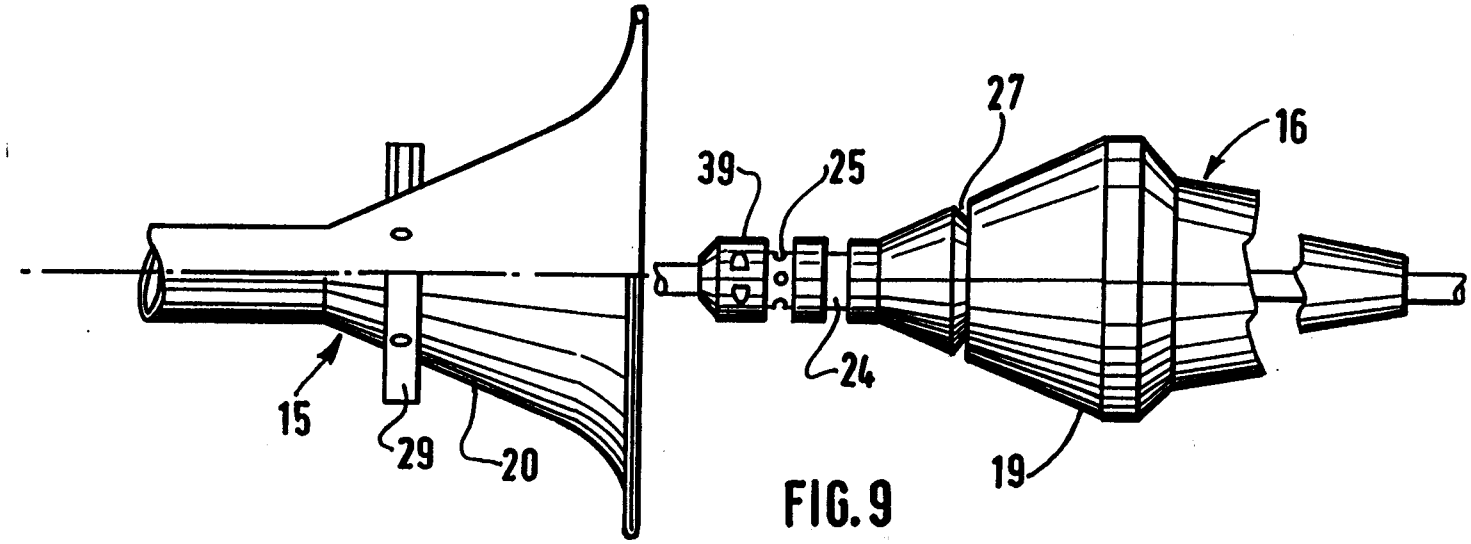
Figure 11:
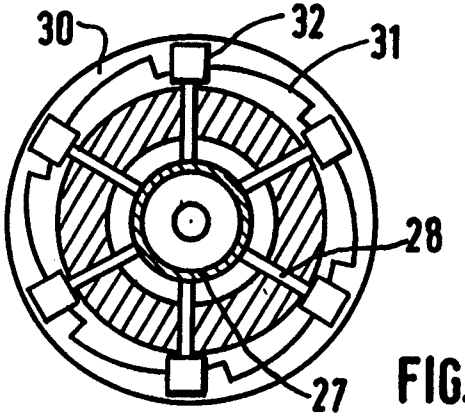
FIG. 11 is a sectional view on XI-CI of FIG. 10, and FIGS. 12 and 13 diagrammatically illustrate another embodiment of the device according to the invention according to two implementation phases, FIG. 12 comprising two zones depicted on a larger scale, FIGS. 14A, 14B, 14C and 15A, 15B diagrammatically illustrate yet another embodiment of the device according to the invention and of its implementation.
Figure 10:
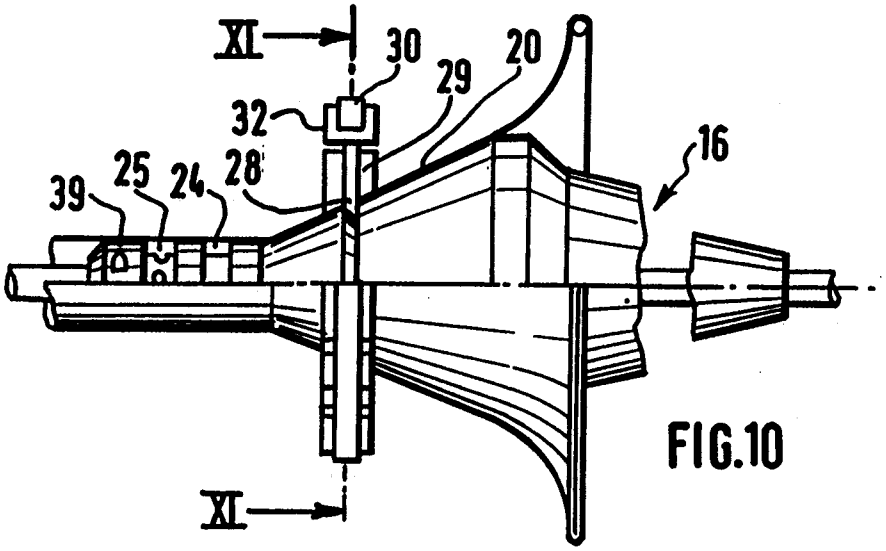

In the embodiment variant illustrated in FIGS. 9 to 11 there is provided, for clamping from the outside, in the frustoconical part 19 secured to the stiffener, a groove 27 able to receive clamping pegs 28 able to slide radially in a guide collar 29 mounted on the mouthpiece 15. The various pegs 28 are capable of being moved radially so as to engage in the groove 27 under the action of a rotary ring 30 fitted with ramp-shaped surfaces 31, the rotation of the ring about the axis of the frustoconical part 20 radially entraining pushers 32 entraining the clamping pegs.

The ring may be made to rotate by any suitable means, particularly by tie rods, thrust cylinders, straight-cut gears or tangential screws, or even by means remotely controlled from the surface. The siting of the clamping pegs in the female frustoconical part is determined such that, as in the preceding embodiment, the interaction of the ramp-shaped surfaces of the groove 27 and of the pegs 28 which act like clamping keys brings about, by wedge effect, a final axial moving together of the opposing frustoconical surfaces respectively secured to the stiffener and to the mouthpiece in order to perform an exact and secure fastening with correspondence of shapes of the corresponding pieces.

Pawls (not shown), in interaction with the groove 24, ensure the retention function beforehand, in the same way as in the preceding embodiment.

Figure 12:
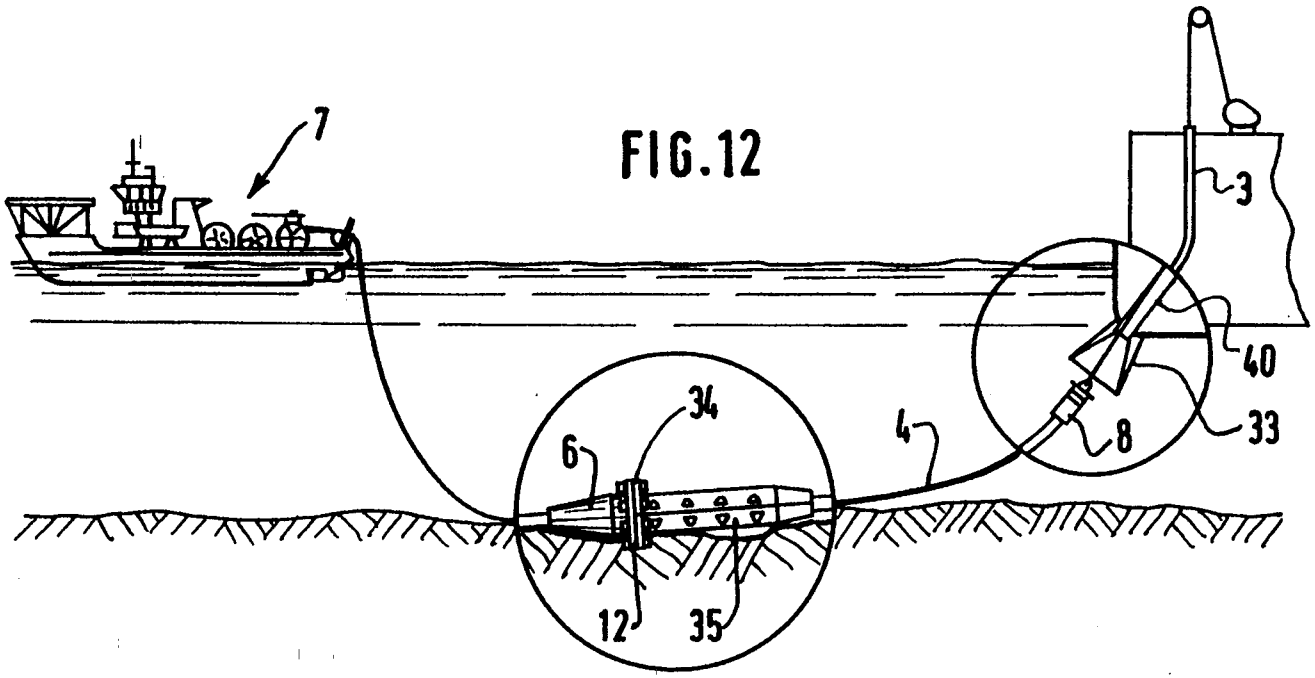
Figure 13:
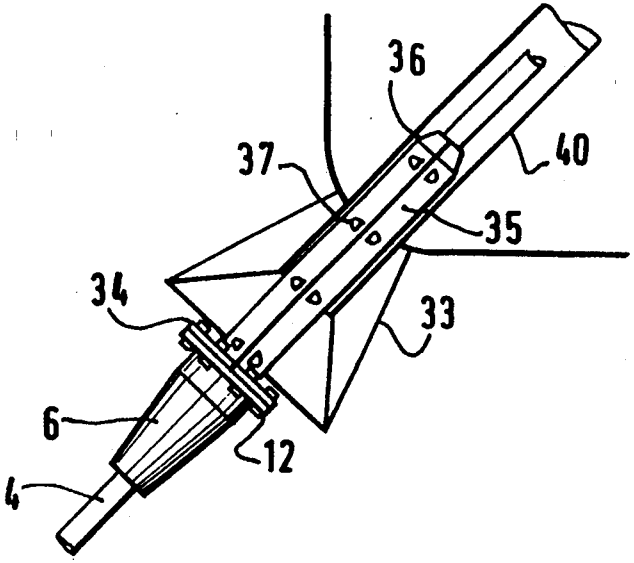

In the embodiment of FIGS. 12 and 13, a mouthpiece 33 is permanently fixed to a cylindrical tube 40 forming the lower end of the tube guide 3. The stiffener 6 is secured via its end flange 12 with the rear end flange 34 of a cylindrical piece 35 whose outer diameter corresponds, with a small clearance, to the internal diameter of the tube 40 in order to produce a fastening with correspondence of shapes inside the tube 40.

The piece 35 in the form of a cylindrical sleeve has a conical end part 36 and is preferably produced in two rigid half-shells comprising means 37 for clamping onto the flexible tubular pipe 4.

The piece 35 is thus securely fixed to the pipe 4 and ensures, in a non-releasable fashion, the immobilisation of the stiffener on the latter at a determined distance from the fitting 8.

It has Just been mentioned that, as a result of the pulling exerted on the flexible pipe, the sleeve 35 secured to the stiffener performs a fastening in correspondence of shape with the cylindrical tube 40 forming the lower end of the tube guide 3.

It is, however, appropriate to note that, bearing in mind the tolerances on the manufacturing diameter of the flexible tubular pipe and of the nature of the means for clamping the two half-shells of the sleeve 35 onto the flexible tubular pipe, it is highly improbable that the assembled sleeve has both a perfectly circular cross-section and an exactly foreseen circumscribed diameter.

Furthermore, the tube 40 constituting the end of the tube guide 3 has its own manufacturing tolerances and may have been locally deformed, particularly by welding or various types of handling.

For this reason, in practice, a certain clearance is allowed between the outer diameter of the sleeve 35 and the internal diameter of the lower cylindrical part 40 of the tube guide. Thus the fastening performed between the assembly made up of the stiffener 6 and the sleeve 35 which are immobilised on the flexible pipe 4, on the one hand and, on the other hand the fastening support made up of the cylindrical tube 40 with the flared mouthpiece 33 is not integral but partial, of the fastening type using cylindrical interlocking as has been described herein above. Such a fastening blocks the bending effects and the radial bearing effects, whilst allowing relative axial sliding between the two assemblies, thus presenting the advantage that the variations in length of the flexible tubular pipe as a function of the variations of internal pressure in the pipe are freely absorbed.

In the cases where this device would risk being affected by permanent detrimental caulking effects, it is possible to interpose an intermediate layer of buffer material able to dampen the impacts in the annular space between the sleeve 35 and the tube 40.

Figure 14B:
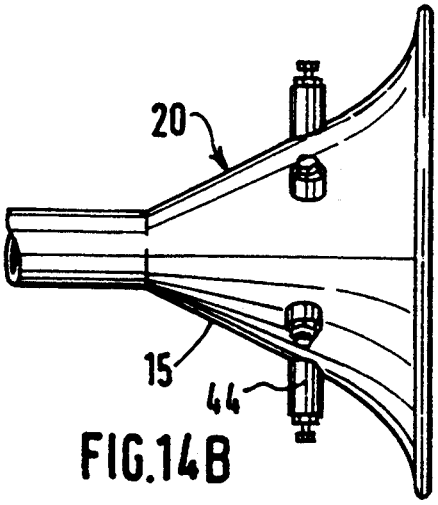
Figure 14A:
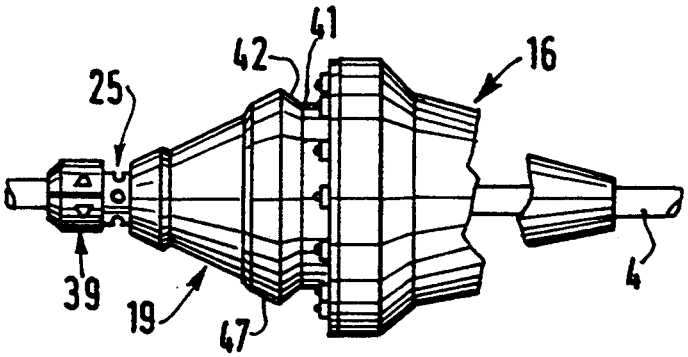
Figure 14C:
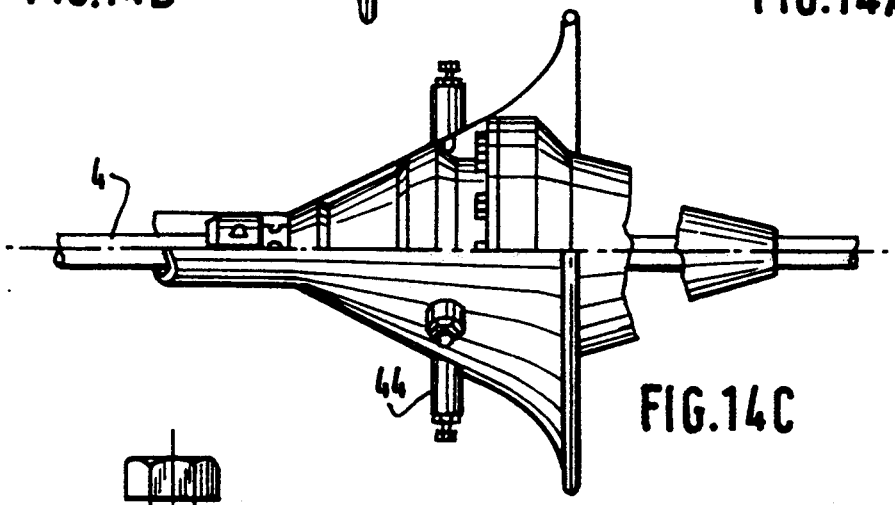
Figure 15A:
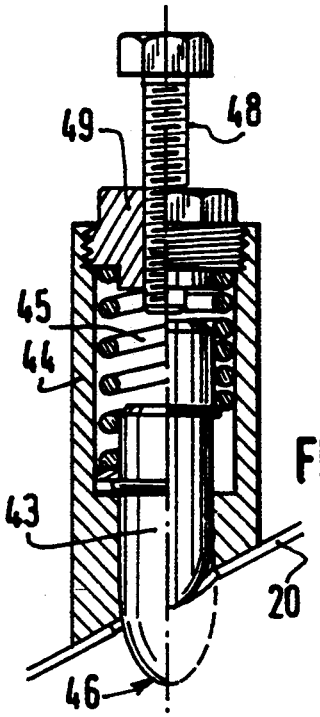
Figure 15B:
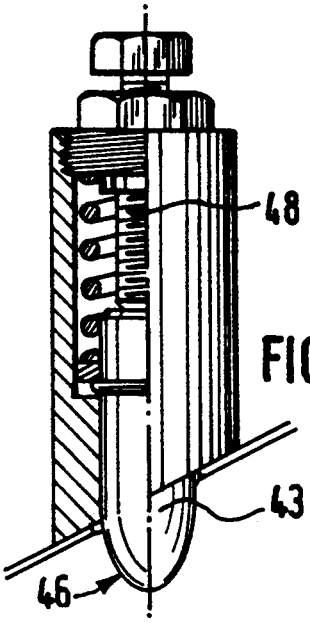

Reference is now made to FIGS. 14 and 15.

As in the embodiment illustrated in FIGS. 9 to 11, the stiffener 16 constitutes the rear part of an assembly which has an axial central passage for the flexible pipe 4 and which comprises a rigid male frustoconical part 19, as well as a front part whose front end comprises an element 39 which can be clamped in a fixed manner like a collar onto the pipe 4 and which thus constitutes a means for immobilising the said assembly secured to the stiffener 16. Between the frustoconical part 19 and the clamping element 39, the front part comprises a breaking zone 25 such as described hereinabove. In the embodiment of FIGS. 14 and 15, the outer surface of the frustoconical part 19 comprises a hollowed annular part 41 whose contour has, in its front part, a conical bearing surface 42.

By pulling the pull cable 14 from the platform support, the end of which cable is connected to the terminal fitting 8 of the pipe 4, and which passes through the central opening which the mouthpiece 15 secured to the platform 1 comprises in the vicinity of its lower part, the flexible pipe 4 and the assembly secured to the stiffener 16 which remains immobilised on the flexible pipe is caused to be raised during the first phase of the pulling operation, by means of the clamping element 39.

The mouthpiece 15, which may constitute the lower part of a tube guide 3, comprises a female frustoconical part 20 defining a conical inner surface which is in correspondence of shapes with the outer surface enveloped by the male frustoconical part 19. A plurality of catches or dogs 43, for example three in number, are arranged inside cases 44 where they are guided so as to be able to move in translation along radial axes with respect to the longitudinal axis of the frustoconical part 20. Springs 45 push the catches 43 towards the centre. The front part, directed towards the axis of the catches has, in a meridian plane passing through the said longitudinal axis of the device, a wedge-shaped outer contour 46.

At rest, the catches 43, pushed by the springs 45, partially leave the cases 44, and their front end comes to extend forwards inside the internal surface of the female frustoconical part 20, as can be seen in the left-hand half of FIG. 15 A.

As the pulling operation continues, the male frustoconical part 19 penetrates inside the female frustoconical part 20 and comes into contact with the front part 46 of the catches 43, in the region of the conical bearing surface 47 of the male frustoconical part 19 which is located Just in front of the hollowed part 41. The zone in question of the front part 46 (broken line on the right-hand half of FIG. 15 A) has a cam-shaped profile so that the catches 43 are pushed back inside the cases 44 compressing the springs 45, so as to free the internal surface of the female frustoconical part 20 (solid line on the right-hand half of FIG. 15A). When the male and female frustoconical parts, respectively 19 and 20, come to bear on one another at the end of the first phase of the pulling operation, the catches 43 are then opposite the hollow part 41 into which they penetrate under the action of the springs 45, to come again into the pushed out position as illustrated on the left-hand half of FIG. 15A. The active zone of the front part 46 of the catches 43, which is the front zone on the apex side of the conical shapes 19 and 20, has a cam-shaped profile such that the catches 43, by penetrating inside the hollowed part 41, bear on the conical bearing surface 42. The radial penetration of the catches 43 which act like clamping keys, thus determines, by wedge effect, an axial clamping force allowing secure fastening of the male frustoconical part 19 secured to the stiffener 16 in the female frustoconical part 20.

It is understood that in this embodiment the catches 43 fulfil, both simultaneously and successively, in interaction with the hollowed part 41 and the conical bearing surface 42, on the one hand, the function of temporarily retaining the stiffener ensured, for example, by the pawls 21 engaging in the groove 24 in the case of the variant of FIGS. 5 to 8, or of the variant of FIGS. 9 to 11 and, on the other hand, the function of clamping the fastening members which was performed by the collar 26 with the flanges 17 and 18 in the case of the variant of FIGS. 5 to 8, and by the pegs 28 penetrating into the groove 27 in the case of the variant of FIGS. 9 to 11.

The device is then locked permanently in the fastening position thus produced. For this purpose, various known mechanical means may be used which make it possible, independently of the action of the springs 45, to irreversibly block the catches 43 against the opposing conical bearing surface 42. In the case illustrated by FIG. 15, bolts 48 are used directed along the same radial axis of the cases 44 as the catches 43, and which are pushed to bear against the rear face of the catches 43 by screwing into nuts 49 secured to the cases 44. The bolts 48 may be screwed, for example, by a remote controlled subsea robot such as an ROV (Remote Operated Vehicle). As a variant, the catches 43 may be locked by fingers, similar to the clamping pegs 28 illustrated by FIGS. 10 and 11, and which are pushed under the effect of the rotation of a rotary ring having ramp-shaped surfaces similar to the ramps 31 of the ring 30. Alternatively, a rotary ring may be used having ramp-shaped surfaces which constitute a cylindrical or conical surface about the longitudinal axis of the frustoconical part 20, and which are not inscribed in a radial plane, in this case, the ramps may act, still by wedge effect, on a lateral face of the rear part of the catches having a slope of suitable angle. It is also possible to produce such devices which are entirely remotely controlled from the surface, for example by using hydraulic motorisation members.

When the connection device has been fastened and locked, it is possible to undertake the second phase of the pulling operation. By resuming the pull on the cable 14, the breakage of the zone 25 is firstly brought about, which makes it possible to release the flexible pipe 4 with respect to the assembly secured to the stiffener 6 which remains permanently fastened to the fastening support 15, the clamping element 39 remaining fixed to the pipe. It is then possible to finish the operation of raising the flexible pipe up until the fitting 8 is connected to the member 38, such as a flange, on board the platform.

Without leaving the scope of the invention, it is possible to install the device for fastening the stiffener into the upper part of the support platform to which the flexible pipe is connected, above sea level, and not, as described hereinabove, in a submerged position in the vicinity of the bottom part of the platform. In this case, the length of the end section of the flexible pipe between its end fitting and the device for fastening the stiffener is relatively less, but the fitting remains separate from the fastening zone.

Although the invention has been described in conjunction with a particular embodiment, it is, of course, obvious that it is in no way limited thereto and that any desirable modifications may be made to it without in any way departing from the scope or the spirit thereof.

What is claimed:

1. A device for mounting a flexible line on a structure, comprising:

a hollow rigid member having one end with a mouth zone and a second end forming part of said structure or being fixed to said structure;

a pull cable fixed to one end of said flexible line for pulling said flexible line through said hollow rigid member;

a curvature limiter engaged on said flexible line;

first fixing means secured to said curvature limiter;

second fixing means secured to said hollow rigid member;

wherein said first and second fixing means interact for fastening the curvature limiter to the hollow rigid member, by pulling the flexible line with said pull cable to bring the curvature limiter to the level of said mouth zone of said hollow rigid member, said device further comprising means for immobilizing movement of said curvature limiter along said flexible line during pulling of said flexible line; and wherein said first and second fixing means and said immobilization means allow said flexible line to be pulled by said pull cable through said hollow rigid member thereby allowing said one end of said flexible line to be connected to said structure.

2. A device according to claim 1, wherein the means for immobilizing the curvature limiter on the flexible line during pulling of said flexible line is axially blocked on the flexible line and is releasable from the said curvature limiter after immobilizing the latter.

3. A device according to claim 2, wherein said releasable immobilization means comprises a collar axially immobilized on the flexible line behind the curvature limiter said curvature limiter bearing against said collar during pulling of said flexible line.

4. A device according to claim 2, wherein said releasable immobilization means are secured to the curvature limiter during said pulling of said flexible line and are connected to it by a breaking zone having a limited predetermined resistance to the axial pulling force.

5. A device according to claim 2, wherein said curvature limiter is mounted on the flexible line so as to allow, after releasing the immobilization means from the curvature limiter, a sliding of the flexible line with respect to this curvature limiter.

6. A device according to claim 1, wherein said mouth zone of said hollow rigid tube has a flared mouthpiece mounted thereon.

7. A device according to claim 6 wherein the flared mouthpiece is separable after fastening said mouthzone of said hollow rigid tube to said curvature limiter.

8. A device according to claim 1, further comprising clamping means for pushing said first and second fixing means into engagement.

9. A device according to claim 8, further comprising retention means for immobilizing the curvature limiter with respect to the hollow rigid member before implementing the clamping means.

10. A device according to claim 1, further comprising frustoconical bearing surfaces located on said curvature limiter and said mouth zone.

11. A device according to claim 1, further comprising cylindrical bearing surfaces located on said curvature limiter and said mouth zone.

12. A device according to claim 1, further comprising cylindrical bearing surfaces located on said curvature limiter and said mouth zone wherein said bearing surfaces have radial clearances allowing mutual axial sliding.

* * * * *